US006492084B2

(12) United States Patent
Tomita

(10) Patent No.: US 6,492,084 B2
(45) Date of Patent: Dec. 10, 2002

(54) TONER FOR USE IN ELECTROPHOTOGRAPHY AND IMAGE FORMATION METHOD USING THE TONER

(75) Inventor: Kunihiko Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/843,176

(22) Filed: Apr. 26, 2001

(65) Prior Publication Data

US 2001/0051310 A1 Dec. 13, 2001

(30) Foreign Application Priority Data

May 1, 2000 (JP) ..... 2000-132277

(51) Int. Cl.[7] ..... G03G 9/087

(52) U.S. Cl. ..... 430/109.3; 430/108.8; 430/120

(58) Field of Search ..... 430/109.1, 108.8, 430/109.3, 120

(56) References Cited

U.S. PATENT DOCUMENTS

| | | | | |
|---|---|---|---|---|
| 4,265,994 A | | 5/1981 | Hasegawa et al. | 430/107 |
| 4,789,617 A | | 12/1988 | Arahara et al. | 430/137 |
| 5,691,093 A | * | 11/1997 | Kanbayashi et al. | 430/47 |

OTHER PUBLICATIONS

Database WPI Sec. Ch. Week 198144, Derwent, AN 1981–80749d, XP002173305, Abstract of JP 56 119139A, 9/81, Japan.

Database WPI Sec. Ch, Week 198825, Derwent, AN1988–171107, XP002173306, Abstract of JP 63 108356A, 5/88, Japan.

* cited by examiner

*Primary Examiner*—John Goodrow
(74) *Attorney, Agent, or Firm*—Cooper & Dunham LLP

(57) ABSTRACT

A toner for use in electrophotography, which includes a coloring agent and a binder including a binder resin which contains therein a cyclized rubber, is proposed, and an image formation method using this toner is also proposed.

22 Claims, No Drawings

TONER FOR USE IN ELECTROPHOTOGRAPHY AND IMAGE FORMATION METHOD USING THE TONER

BACKGROUND OF THE INVENTION

1. Field of the Invention

The present invention relates to a toner for use in electrophotographic copying machines, facsimile apparatus, and printers, and an image formation method using the toner.

2. Discussion of Background

Conventionally, thermal image fixing is often used for fixing toner images.

According to the principle of thermal toner image fixing, a toner to be fixed has to be softened or melted by the heat applied thereto by an image fixing unit. Furthermore, the softened or melted toner has to be embedded in the fibers of paper by the pressure applied thereto by the image fixing unit, or has to be caused to adhere to the fibers with the adhesive force generated at the surface of the softened or melted toner.

In light of the toner fixing mechanism mentioned above, the melting point or softening point of a resin for use in the toner is required to be equal to or lower than the image fixing temperature set by the image fixing unit.

In recent years, there is an increasing demand for energy saving from the viewpoint of environmental protection. The energy that can be used in the image fixing unit is now being restricted.

In practice, in order to reduce the energy required for image fixing, there is no choice but to lower the image fixing temperature that is set in the image fixing unit. To cope with an image fixing unit with a lowered image fixing temperature, there is necessarily no choice but to employ a resin with a lower melting point as the resin for use in the toner. However, the resin with a low melting point tends to readily soften, so that toner particles containing the above-mentioned resin readily cause a blocking problem. Further, the mutual action between the toner particles and additives externally added to the toner particles changes with time because of the adhesion of the surface of the toner particles, thereby causing changes in the characteristics of toner. The result is that the preservation stability of the toner is impaired.

Furthermore, the toner prepared using the above-mentioned resin is so soft and adhesive that even in a developer unit, there occurs a so-called spent phenomenon with the deposition of the toner on the surface of a carrier to use up the carrier. Further, the toner causes the problem of adhering in the form of a film to the surface of a development roller, which phenomenon is referred to as the toner filming, and the toner also has the problem of being easily deposited on a developer blade in the developer unit.

Furthermore, after the completion of image fixing, image-bearing sheets unfavorably stick to each other, depending on the environmental conditions, which is referred to as a blocking phenomenon.

In addition to the above, another problem occurs in the preparation of the toner using a conventional resin with a low melting point. Namely, it is difficult to efficiently pulverize the toner, and the toner easily sticks to the inner wall of a pulverizer, because the resin is excessively soft.

SUMMARY OF THE INVENTION

It is therefore a first object of the present invention to provide a toner for use in electro-photography, from which the conventional problems of the prior art have been eliminated, which has a lower image fixing temperature than that of a conventional toner, thereby achieving the saving of energy, and also has the following characteristics:

1. Having excellent storage stability
2. not reacting with externally added additives and causing no changes in the characteristics with time
3. Not causing the spent phenomenon, toner filming, and deposition
4. Imparting excellent preservability to materials printed with the toner
5. Having excellent grindability A second object of the present invention is to provide an image formation method using the above-mentioned toner.

The inventor of the present invention has discovered an image fixing system capable of carrying out image fixing by using in a toner (1) a resin having such a melting point that is higher than the lowest temperature in image fixing, and (2) a wax having such a melting point that is lower than the lowest temperature in image fixing. In this case, the wax serves as a solvent or a plasticizer when heated to the melting point of the wax or to a temperature above the melting point of the wax, so that the resin is dissolved on a molecular level in the wax, and the image fixing can be carried out at a temperature that is lower than the melting point of the resin, with the resin being softened or dissolved in the wax.

Based on this knowledge, the inventor of the present invention has also discovered that image fixing can be carried out using a toner comprising a cyclized rubber with a high melting point. Further, when the cyclized rubber is used in combination with a wax which has a melting point by far lower than that of the cyclized rubber, image fixing can be achieved at a temperature near the melting point of the wax. Thus, the inventor has found a toner for use in electrophotography capable of energy saving.

In the present invention, the melting point of the cyclized rubber indicates a softening point thereof measured by a flow tester method. Furthermore, in the present invention, the melting point of the wax indicates a temperature at which the crystals of the wax mostly become amorphous and transparent. Namely, the concept of the term "melting point" used in the present invention is different from that of the glass transition temperature (Tg) measured by the DSC method, or from that of a top peak in an endothermic curve. For example, in the case of cyclized isoprene, the measurement by use of the DSC method indicates an endothermic peak at a temperature in a range of from 50° C. to 80° C. However, practically, the cyclized isoprene is clearly in a solid state at temperatures of about 100° C.

The first object of the present invention can be achieved by a toner comprising a coloring agent, and a binder which comprises a binder resin comprising a cyclized rubber.

In the above toner, the cyclized rubber may be contained in an amount of 10 wt. % or more of the total amount of the binder resin.

In the above toner, it is preferable that the cyclized rubber have a cyclization degree of 40% or more.

Furthermore, in the above toner, the binder may further comprise a wax, which dissolves therein the cyclized rubber when heated to the melting point of the wax or above. The wax servers as a solvent for the cyclized rubber.

Furthermore, in the above toner, it is preferable that the composition ratio of the wax to the cyclized rubber (the wax: the cyclized rubber) be (97:3) to (5:95) on a weight basis.

In the above toner, the melting point of the wax is lower than the melting point of the cyclized rubber.

It is preferable that the wax have a melt viscosity of 1 to 10,000,000 centipoise at 150° C.

It is also preferable that the wax have a penetration of 0 to 20 at 25° C.

It is preferable that the wax comprise at least one wax component selected from the group consisting of paraffin wax, microcrystalline wax, olefin wax, and oxidized wax or be selected from the group of the above-mentioned waxes.

The toner of the present invention is fixable at a temperature equal to or lower than the melting point of the cyclized rubber.

The second object of the present invention can be achieved by an electrophotographic image formation method, using the above-mentioned toner.

DESCRIPTION OF THE PREFERRED EMBODIMENTS

The toner for use in electrophotography of the present invention will now be explained in more detail.

In the present invention, as a main binder, there is employed a cyclized rubber which has a high melting point and excellent preservability, and high resistance to occurrence of the spent phenomenon, toner filming, and deposition on the developer blade.

The binder for use in the toner may further comprise a wax. In this case, the cyclized rubber is dissolved in the wax. The cyclized rubber dissolved in the wax is then solidified and used as the toner.

When the thus prepared toner is subjected to thermal image fixing, the cyclized rubber is dissolved in the wax at or above the melting point of the wax, so that the cyclized rubber is softened or dissolved. Thus, the image fixing performance can be exhibited before the temperature reaches the melting point of the cyclized rubber. Furthermore, the cyclized rubber itself has a high melting point and therefore is not too soft for pulverizing, so that excellent grindability can be obtained in the preparation of toner particles.

When the binder comprises the cyclized rubber and a conventional resin, both constituting a binder resin, it is preferable that the composition ratio of the cyclized rubber in the binder resin be 10 wt. % or more. When the composition ratio of the cyclized rubber is less than 10 wt. %, the melting point of the toner cannot be sufficiently lowered so that improper image fixing will take place.

It is more preferable that the content of the cyclized rubber be 15 wt. % or more, more preferably 20 wt. % or more, further more preferably 30 wt. % or more, even more preferably 40 wt. % or more, and most preferably 50 wt. % or more.

With respect to the composition ratio of the wax to the cyclized rubber, the more the amount of the wax, the lower the melt viscosity of the cyclized rubber. When the amount of the cyclized rubber is decreased, other resin is neither dissolved in the wax, nor mixed with the wax, so that the resin is separated from the wax and therefore it is difficult to prepare the toner.

On the other hand, when the amount of the cyclized rubber is too large, and the amount of the wax is too small, even if the cyclized rubber is dissolved in the wax, the melt viscosity thereof becomes excessively high so that an appropriate image fixing performance is not exhibited.

The inventor's study indicates that it is preferable that the composition ratio of the wax to the cyclized rubber (the wax:the cyclized rubber) be 97:3 to 5:95 in order to have a proper image fixing performance exhibited.

The toner is used not only in a well-air-conditioned office, but also under various environmental conditions, such as at high temperatures, low temperatures, high humidities, and low humidities. With these various environmental conditions taken into consideration, it is more preferable that the composition ratio of the wax to the cyclized rubber be in the range of (95:5) to (20:80), and furthermore preferably (90:10) to (30:70). When more tolerance is taken into consideration, the most preferable composition ratio of the wax to the cyclized rubber is in the range of (80:20) to (40:60).

Unless a wax of which melting point is lower than that of the cyclized rubber is used, the wax is not melted at or below the melting point of the cyclized rubber, and as a matter of course, the cyclized rubber cannot be dissolved in the wax. Accordingly, the melting point of the toner cannot be lowered. Therefore, it is preferable that the wax have a melting point of 50° C. to 130° C., more preferably a melting point of 50° C. to 1100° C., further more preferably a melting point of 50° C. to 1000° C., and most preferably a melting point of 50° C. to 90° C.

The lower the melt viscosity of the wax, the better. However, the inventor of the present invention is not aware of the presence of a wax with a melt viscosity of less than 1 centipoise. On the contrary, when the melt viscosity of the wax is extremely high, the solution of the cyclized rubber in the wax has an extremely high viscosity. When the melt viscosity of the wax is more than 10,000,000 centipoise, improper image fixing is apt to take place due to the excessively high melt viscosity.

Since the toner is considered to be used in practice not only in a well-air-conditioned office, but also under various environmental conditions, such as at high temperatures, low temperatures, high humidities, and low humidities, waxes with a melt viscosity at 1500° C. ranging from 1 to 10,000,000 centipoise can be employed in the present invention.

It is preferable that the melt viscosity at 150° C. of the wax for use in the present invention be in the range of 1 to 100,000 centipoise, more preferably 1 to 10,000 centipoise, further more preferably 1 to 1,000 centipoise, and most preferably 1 to 100 centipoise when more tolerance is taken into consideration.

The inventor's studies indicated that waxes having a penetration of 0 to 20 at 25° C. can be effectively used in the present invention. Generally, the higher the penetration of the wax, the greater the tack strength of the wax itself, and accordingly the more noticeable the tendency of the occurrence of the toner spent phenomenon, the toner filming, and the deposition of the toner, thereby generating unfavorable results. When the use of the toner at high temperatures is taken into consideration, it is preferable that the penetration of the wax be in the range of 0 to 8, and more preferably in the range of 0 to 5.

Generally, as waxes and wax-like materials, there are known straight chain paraffin wax, slightly branched microcrystalline wax, olefin wax, fatty acid, ester of fatty acid, aliphatic ketone, aliphatic amine, aliphatic amide, aliphatic alcohol, and sterol. In these waxes and wax-like materials, the portion of alkyl group is extremely long and other functional group portions are bonds or groups in part of the molecule thereof, so that each of these waxes and wax-like materials as a whole has an extremely low polarity, which is suitable for use in the present invention.

Examples of the waxes for use in the present invention include paraffin wax, microcrystalline wax, oxidized paraffin wax, oxidized microcrystalline wax, montanic acid, montanic acid ester, carnauba wax, candelilla wax, rice wax, esparto, castor wax, Japan wax, beedswax, jojoba wax, sterol waxes, and ketone wax.

Of these waxes, paraffin wax, microcrystalline wax, olefin wax, oxidized paraffin wax, oxidized micro-crystalline wax, and oxidized olefin wax are particularly preferable for use in the present invention. It was discovered by the inventor that the solubility of the cyclized rubber in these waxes is high, and therefore, the cyclized rubber can be dissolved in a short time in the course of the preparation of the toner. It is considered that this is because each of paraffin wax, microcrystalline wax, olefin wax, oxidized paraffin wax, oxidized microcrystalline wax, and oxidized olefin wax has a particularly low polarity, and therefore shows good compatibility with the cyclized portion of the cyclized rubber.

Furthermore, the inventor's studies indicated that a cyclized rubber having a cyclization degree of 40% or more on average can exhibit its excellent characteristics for use in the present invention. When the cyclization degree of the cyclized rubber is lower than the above-mentioned cyclization degree, the cyclized rubber tends to lose its solubility in the wax and therefore cannot sufficiently exhibit its characteristics for use in the present invention. A cyclized rubber with a cyclization degree of about 30% is soft and has more liquid-like characteristics. The inventor's further studies indicated that it is preferable that the cyclized rubber for use in the present invention have a cyclization degree of 70% or more.

The above-mentioned cyclized rubber for use in the present invention can be prepared, for example, by the following Fisher's method:

The cyclized rubber is prepared by kneading a rubber with the addition thereto of concentrated sulfuric acid serving as a cyclizing agent in an amount of 5%, and heating the kneaded mixture to 130° C. for 15 hours. As the cyclizing agent, there can be employed, in addition to the above-mentioned concentrated sulfuric acid, organic sulfonic acid, tin chloride, iron chloride, non-metallic halide, and halogenated primary and secondary stannic acids, whereby various resinous plastic materials can be prepared. In these materials, isomerization can occur by the action of an oxidizing chemical as shown in the following scheme, so that it is possible to obtain materials having entirely different characteristics from those of the starting material by an increase in specific gravity and a decrease in degree of unsaturation. The cyclized rubber for use in the present invention can be obtained by the above-mentioned method.

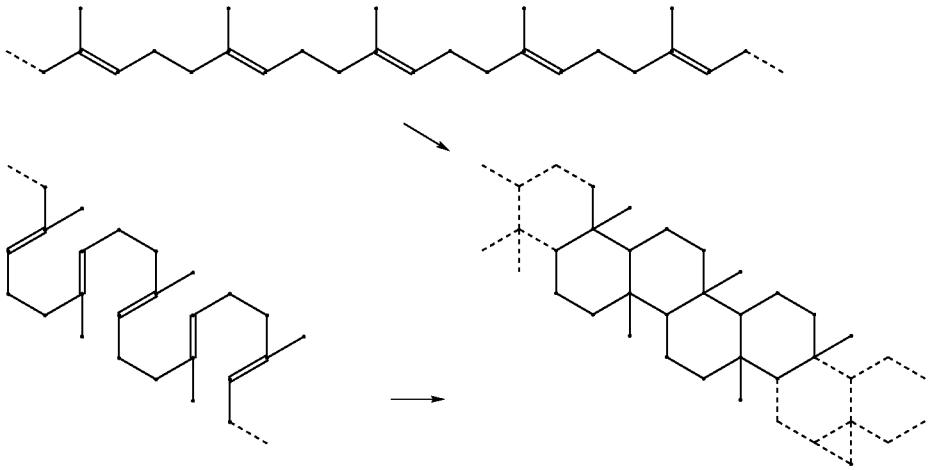

In the toner of the present invention, the binder resin may further comprise the following resins:

Homopolymers of styrene and substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinyl-naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloro-methacrylate copolymer, styrene-acrylonitrile copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleate copolymer; and poly (methyl methacrylate), poly(butyl methacrylate), poly(vinyl chloride), poly(vinyl acetate), polyester, polyurethane, polyamide, epoxy resin, poly(vinyl butyral), polyacrylic acid resin, rosin, modified rosin, terpene resin, aliphatic or alicyclic hydrocarbon resin, aromatic petroleum resin, and chlorinated paraffin. These resins may be used alone or in combination.

A coloring agent such as carbon black or a color pigment is dispersed by kneading with the above-mentioned binder resin. A charge control agent may also be contained in the toner.

The toner thus prepared is pulverized to produce toner particles. To control the fluidity of the toner particles, an additive such as silica, titanium, or strontium may be added to the toner particles.

It is conventionally known that a resin in which a wax is dispersed is used in the toner. This is for improving the releasability of the toner from an image fixing roller at the time of image fixing, since when the wax is dispersed in the resin for use in the toner, the wax is softened or made fluid at the time of image fixing and oozes from the toner and helps the releasing of the toner from the surface of the image fixing roller. The conventionally employed resin, however, is insoluble in the wax, so that the resin cannot be dissolved in the wax and also cannot be softened by the wax.

In contrast to this, the cyclized rubber for use in the present invention can be dissolved in the fluid wax or plasticized by the fluid wax at or above the melting point of the wax. The use of the wax in the present invention is completely different from that in the above-mentioned conventional method.

In the following prior art references, there are disclosed the use of the wax in a manner which appears similar to the manner in the present invention: Japanese Laid-Open Patent Application 7-271100, Japanese Patent Publication 7-15596, Japanese Patent Publication 7-31418, Japanese Patent Publication 7-40146, Japanese Patent Publication 7-62765, Japanese Patent Publication 7-82248, Japanese Patent Publication 7-104612, Japanese Patent 2548091, and Japanese Patent 2759482.

However, in any of the methods disclosed in these prior art references, the wax is used as a dispersion stabilizer at the time of preparation of a toner by suspension polymerization, or used for forming shells for catching and capsuling resin particles with a low melting point, which are formed by polymerization at the preparation of polymerized toner particles. In this case, the wax is used as a capsule formation material in order to prevent the blocking of the formed toner particles. Thus, in the above conventionally known methods, the wax is used in an entirely different manner from that in the present invention.

Other features of this invention will become apparent in the course of the following description of exemplary embodiments, which are given for illustration of the invention and are not intended to be limiting thereof.

EXAMPLE 1

A mixture of the following components was fused and kneaded in a three-roll mill five times, and thereafter cooled.

| | wt. % |
|---|---|
| Cyclized polyisoprene | 78 |
| Sazol wax | 16 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 1 according to the present invention was obtained.

EXAMPLE 2

A mixture of the following components was fused and kneaded in a three-roll mill five times, and thereafter cooled.

| | wt. % |
|---|---|
| Cyclized polyisoprene | 50 |
| Sazol wax | 10 |
| Magnetic material | 39 |
| Charge control agent | 1 |

The cooled mixture was pulverized to prepare toner particles. 100 parts by weight of the toner particles were mixed with one part by weight of silica serving as an external additive, whereby a toner No. 2 according to the present invention was obtained.

EXAMPLE 3

A mixture of the following components was fused and kneaded in a three-roll mill five times, and thereafter cooled.

| | wt. % |
|---|---|
| Cyclized polyisoprene | 72 |
| Carnauba wax | 22 |

-continued

| | wt. % |
|---|---|
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 3 according to the present invention was obtained.

EXAMPLE 4

A mixture of the following components was fused and kneaded in a three-roll mill five times, and thereafter cooled.

| | wt. % |
|---|---|
| Cyclized polyisoprene | 72 |
| Montanic acid ester | 39 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 4 according to the present invention was obtained.

EXAMPLE 5

A mixture of the following components was fused and kneaded in a three-roll mill five times, and thereafter cooled.

| | wt. % |
|---|---|
| Cyclized polyisoprene | 78 |
| 155 F° Paraffin wax | 16 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 5 according to the present invention was obtained.

EXAMPLE 6

A mixture of the following components was fused and kneaded in a three-roll mill five times, and thereafter cooled.

| | wt. % |
|---|---|
| Cyclized polyisoprene | 74 |
| Rice wax | 20 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 6 according to the present invention was obtained.

EXAMPLE 7

A mixture of the following components was fused and kneaded in a three-roll mill five times, and thereafter cooled.

| | wt. % |
|---|---|
| Cyclized polyisoprene | 74 |
| Oxidized paraffin | 20 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 7 according to the present invention was obtained.

EXAMPLE 8

A mixture of the following components was fused and kneaded in a three-roll mill five times, and thereafter cooled.

| | wt. % |
|---|---|
| Cyclized polyisoprene | 94 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 8 according to the present invention was obtained.

EXAMPLE 9

A mixture of the following components was fused and kneaded in a three-roll mill five times, and thereafter cooled.

| | wt. % |
|---|---|
| Cyclized polyisoprene | 74 |
| Oxidized paraffin | 20 |
| Cyan pigment | 5 |
| Charge control agent | 1 |

The cooled mixture was pulverized to prepare toner particles. 100 parts by weight of the toner particles were mixed with one part by weight of silica serving as an external additive, whereby a toner No. 9 according to the present invention was obtained.

EXAMPLE 10

A mixture of the following components was fused and kneaded in a three-roll mill five times, and thereafter cooled.

| | wt. % |
|---|---|
| Cyclized polyisoprene | 72 |
| Carnauba wax | 22 |
| Yellow pigment | 5 |
| Charge control agent | 1 |

The cooled mixture was pulverized to prepare toner particles. 100 parts by weight of the toner particles were mixed with one part by weight of silica serving as an external additive, whereby a toner No. 10 according to the present invention was obtained.

EXAMPLE 11

A mixture of the following components was fused and kneaded in a three-roll mill five times, and thereafter cooled.

| | wt. % |
|---|---|
| Cyclized polyisoprene | 42 |
| High-melting point polyester (mp: 155° C.) | 30 |
| Carnauba wax | 22 |
| Carbon black | 5 |
| Charge control agent | 1 |

The cooled mixture was pulverized to prepare toner particles. 100 parts by weight of the toner particles were mixed with one part by weight of silica serving as an external additive, whereby a toner No. 11 according to the present invention was obtained.

COMPARATIVE EXAMPLE 1

A mixture of the following components was fused and kneaded in a three-roll mill five times, and thereafter cooled.

| | wt. % |
|---|---|
| High-melting point polyester (mp: 155° C.) | 94 |
| Carbon black | 5 |
| Charge control agent | 1 |

The cooled mixture was pulverized to prepare toner particles. 100 parts by weight of the toner particles were mixed with one part by weight of silica serving as an external additive, whereby a comparative toner No. 1 was obtained.

COMPARATIVE EXAMPLE 2

A mixture of the following components was fused and kneaded in a three-roll mill five times, and thereafter cooled.

| | wt. % |
|---|---|
| Low-melting point polyester (mp: 94° C.) | 94 |
| Carbon black | 5 |
| Charge control agent | 1 |

The cooled mixture was pulverized to prepare toner particles. 100 parts by weight of the toner particles were mixed with one part by weight of silica serving as an external additive, whereby a comparative toner No. 2 was obtained.

COMPARATIVE EXAMPLE 3

A mixture of the following components was fused and kneaded in a three-roll mill five times, and thereafter cooled.

| | wt. % |
|---|---|
| High-melting point polyester (mp: 155° C.) | 78 |
| Sazol wax | 16 |
| Carbon black | 5 |
| Charge control agent | 1 |

In this case, the resin component was separated from the wax component, and therefore, it was impossible to prepare a toner.

A: Measurement of Image Fixing Temperature

Each of the obtained toners No. 1 to No. 11 according to the present invention and comparative toners No. 1 and No. 2 was set in a developer unit of an electrophotographic copying machine. With the temperature of an image fixing unit being variously changed, the permissible image fixing temperature was obtained. In any case, a releasing oil was applied to the surface of an image fixing roller. The results are shown in TABLE 1.

TABLE 1

| | Surface Temperature of Image Fixing Unit (° C.) | | | | | | |
|---|---|---|---|---|---|---|---|
| | 70 | 80 | 90 | 100 | 120 | 140 | 160 |
| Ex. 1 | | X | X | ○ | ○ | | |
| Ex. 2 | | X | X | ○ | ○ | | |
| Ex. 3 | | X | ○ | ○ | | | |
| Ex. 4 | X | ○ | ○ | | | | |
| Ex. 5 | X | ○ | ○ | | | | |
| Ex. 6 | X | ○ | ○ | | | | |
| Ex. 7 | | X | ○ | ○ | | | |
| Ex. 8 | | | | | X | X | ○ |
| Ex. 9 | | X | ○ | ○ | | | |
| Ex. 10 | | X | ○ | ○ | | | |
| Ex. 11 | | X | ○ | ○ | | | |
| Comp. Ex. 1 | | | | | X | X | ○ |
| Comp. Ex. 2 | | | X | ○ | ○ | | |

In the above TABLE 1, "○" means that fixing of toner images was satisfactorily carried out, and "X" means that defective fixing occurred.

As can be seen from the results shown in TABLE 1, when the high-melting point polyester resin is used alone as the binder in Comparative Example 1, the lower limit image fixing temperature is as high as 160° C.

In contrast to this, when a cyclized rubber is used in combination with a wax, the lower limit image fixing temperature can be decreased by 60 to 80° C.

B: Preservation Test

Each of the toners was subjected to a preservation test by allowing each toner to stand at 40° C. for 2 weeks. The preservation stability of toner was evaluated in terms of the following two points:

(1) Charge quantity

The charge quantity of a one-component developer was measured on a development sleeve before and after storage.

(2) Toner deposition on background of OPC

The degree of toner deposition on the background of an electrophotographic photoconductor was examined in such a manner that a transparent adhesive tape was put on the surface of the background portion of the photoconductor after copying operation, and separated therefrom, and then attached to a sheet of fresh white paper. The optical density ($ID^1$) of the tape-attached portion was measured.

Another transparent adhesive tape was attached to the surface of a sheet of fresh white paper, and the optical density ($ID^2$) of the tape-attached portion was also measured. The difference ($\Delta ID$) determined by the following formula was obtained.

$$\Delta ID = ID^1 - ID^2$$

The smaller the value of $\Delta ID$, the less the toner deposition on the background of the photoconductor.

The results are shown in TABLE 2.

TABLE 2

| | Condition | Charge Quantity ($\mu$C/g) | | Toner Deposition on Background of OPC | |
|---|---|---|---|---|---|
| | after Storage | Before storage | After storage | Before storage | After storage |
| Ex. 1 | ○ | −24 | −24 | 0.00 | 0.00 |
| Ex. 2 | ○ | −23 | −23 | 0.00 | 0.00 |
| Ex. 3 | ○ | −23 | −23 | 0.00 | 0.00 |
| Ex. 4 | ○ | −22 | −21 | 0.00 | 0.00 |
| Ex. 5 | ○ | −23 | −22 | 0.00 | 0.00 |
| Ex. 6 | ○ | −23 | −23 | 0.00 | 0.00 |
| Ex. 7 | ○ | −24 | −23 | 0.00 | 0.00 |
| Ex. 8 | ○ | −22 | −22 | 0.00 | 0.00 |
| Ex. 9 | ○ | −23 | −22 | 0.00 | 0.00 |
| Ex. 10 | ○ | −23 | −23 | 0.00 | 0.00 |
| Ex. 11 | ○ | −22 | −22 | 0.01 | 0.00 |
| Com Ex. 1 | ○ | −22 | −15 | 0.01 | 0.04 |
| Comp. Ex. 2 | Completely solidified | −20 | Not measured | 0.01 | Not measured |

In TABLE 2, "○" means that no change was observed after storage.

As can be seen from the results shown in TABLE 2, the preservation stability of the toners according to the present invention is excellent. In Comparative Example 1 where a high-melting point polyester is used alone as the binder, there are some changes in properties and the preservation stability becomes slightly poor, but acceptable for practical use.

However, the comparative toner No. 2 using a low-melting point polyester resin as the binder caused caking and was completely solidified during the storage. Therefore, the measurement was not carried out after the storage.

C: Running Test

Each of the toners was subjected to a running test by making 2,000 copies. The change in charge quantity and the change in degree of toner deposition on background of the photoconductor were checked before and after the running test.

The charge quantity and the toner deposition on the background of the photoconductor were measured in the same manner as mentioned above in the preservation test.

The results are shown in TABLE 3.

TABLE 3

| | Charge Quantity ($\mu$C/g) | | Toner Deposition on Background of OPC | |
|---|---|---|---|---|
| | Before running test | After running test | Before running test | After running test |
| Ex. 1 | −24 | −24 | 0.00 | 0.01 |
| Ex. 2 | −23 | −23 | 0.00 | 0.01 |
| Ex. 3 | −23 | −23 | 0.00 | 0.01 |
| Ex. 4 | −22 | −21 | 0.00 | 0.01 |
| Ex. 5 | −23 | −22 | 0.00 | 0.01 |
| Ex. 6 | −23 | −23 | 0.00 | 0.01 |
| Ex. 7 | −24 | −23 | 0.00 | 0.01 |
| Ex. 8 | −22 | −22 | 0.00 | 0.01 |

TABLE 3-continued

| | Charge Quantity (μC/g) | | Toner Deposition on Background of OPC | |
|---|---|---|---|---|
| | Before running test | After running test | Before running test | After running test |
| Ex. 9 | −23 | −22 | 0.00 | 0.01 |
| Ex. 10 | −23 | −23 | 0.00 | 0.01 |
| Ex. 11 | −22 | −22 | 0.01 | 0.01 |
| Comp. Ex. 1 | −22 | −15 | 0.01 | 0.06 |
| Comp. Ex. 2 | −20 | −10 | 0.01 | 0.12 |

As can be seen from the results shown in TABLE 3, with respect to the toners according to the present invention, the change in charge quantity is trifling, and the degree of toner deposition on the background of the photoconductor does not practically change before and after the running test.

As for the comparative toner No. 1, the charge quantity tends to lower and the toner deposition on the background tends to increase after the running test. In the case of the comparative toner No. 2, the charge quantity drastically decreases and the degree of toner deposition on the background is not acceptable for practical use.

D: Observation of Developer Unit after Image Formation

Each toner was used in combination with a carrier to prepare a two-component developer. Using each two-component developer, 2,000 copies were made to examine whether melted toner adhered to the surface of the carrier or not (spent toner phenomenon). Furthermore, after 2,000 copies were made using a one-component developer, it was examined whether the surface of a development roller was coated with a film of toner (toner filming phenomenon) and whether the toner particles were deposited on a developer blade in the developer unit.

The results are shown in TABLE 4.

TABLE 4

| | Spent Toner Phenomenon | Toner Filming | Toner Deposition on Developer Blade |
|---|---|---|---|
| Ex. 1 | 1 | 1 | 1 |
| Ex. 2 | 1 | 1 | 1 |
| Ex. 3 | 1 | 1 | 1 |
| Ex. 4 | 1 | 1 | 1 |
| Ex. 5 | 1 | 1 | 1 |
| Ex. 6 | 1 | 1 | 1 |
| Ex. 7 | 1 | 1 | 1 |
| Ex. 8 | 1 | 1 | 1 |
| Ex. 9 | 1 | 1 | 1 |
| Ex. 10 | 1 | 1 | 1 |
| Ex. 11 | 1 | 2 | 1 |
| Comp. Ex. 1 | 2 | 2 | 2 |
| Comp. Ex. 2 | 3 | 3 | 3 |

In TABLE 4, the evaluation level 1 means that no problem occurred; the evaluation level 2, the phenomenon slightly occurred, but acceptable for practical use; and the evaluation level 3, the phenomenon was so serious that image quality was adversely affected.

As can be seen from the results shown in TABLE 4, when any toner according to the present invention is used for image formation, the spent toner, toner filming, and toner deposition on the developer blade can be completely prevented.

As for the comparative toner No. 1, the toner filming phenomenon, the spent toner phenomenon, and the deposition of toner on the developer blade are slight, but this toner is acceptable for practical use in terms of this point.

In the case of the comparative toner No. 2, the toner filming phenomenon, the spent toner phenomenon, and the deposition of toner on the developer blade are very noticeable. In fact, because of those phenomena, defective images were produced. For example, the image density was uneven, the toner deposition appeared on the background of a sheet of image-receiving paper, and non-printed vertical white stripes were observed in image portions.

E: Preservability of Image-bearing Material

After completion of fixing of toner images on sheets, the preservability of the toner-image-bearing sheets was examined by continuously performing image formation on one side of a sheet, and on both sides of a sheet.

The results are shown in TABLE 5.

TABLE 5

| | Printing on One Side | Printing on Both Sides |
|---|---|---|
| Ex. 1 | 1 | 1 |
| Ex. 2 | 1 | 1 |
| Ex. 3 | 1 | 1 |
| Ex. 4 | 1 | 1 |
| Ex. 5 | 1 | 1 |
| Ex. 6 | 1 | 1 |
| Ex. 7 | 1 | 1 |
| Ex. 8 | 1 | 1 |
| Ex. 9 | 1 | 1 |
| Ex. 10 | 1 | 1 |
| Ex. 11 | 1 | 1 |
| Comp. Ex. 1 | 1 | 1 |
| Comp. Ex. 2 | 2 | 3 |

In TABLE 5, the evaluation level 1 means that no problem occurred; the evaluation level 2, the rear surface of a sheet was slightly stained with toner because of transfer of toner from the underlying sheet; and the evaluation level 3, the toner deposited on the front side of one sheet and the toner deposited on the rear side of the overlying sheet produced a blocking problem.

The sheets were stained with toner and the blocking phenomenon occurred when the comparative toner No. 2 was employed.

F: Efficiency of Pulverizing Step

The efficiency of the pulverizing step was evaluated in the course of preparation of toner particles. To be more specific, the period of time required to obtain a fixed amount of toner particles with a predetermined particle size was measured, and the inside of a pulverizer was visually observed.

The results are shown in TABLE 6.

TABLE 6

| | Time Required for Pulverizing (hr.) | Toner Deposition on Inner Wall of Pulverizer |
|---|---|---|
| Ex. 1 | 0.25 | None |
| Ex. 2 | 0.25 | None |
| Ex. 3 | 0.25 | None |
| Ex. 4 | 0.25 | None |
| Ex. 5 | 0.25 | None |
| Ex. 6 | 0.25 | None |
| Ex. 7 | 0.25 | None |
| Ex. 8 | 0.25 | None |
| Ex. 9 | 0.25 | None |
| Ex. 10 | 0.25 | None |
| Ex. 11 | 0.50 | None |
| Comp. Ex. 1 | 0.75 | None |

TABLE 6-continued

| | Time Required for Pulverizing (hr.) | Toner Deposition on Inner Wall of Pulverizer |
|---|---|---|
| Comp. Ex. 2 | 2.00 | Toner particles were accumulated on the target in the pulverizer. |

In the case of the preparation of the toners according to the present invention, there was no problem in the pulverizing step. However, as for the comparative toners No. 1 and No. 2, it took much time to pulverize the toner composition. In addition, toner particles were scattered and considerably deposited on the inner wall of the pulverizer when the comparative toner No. 2 was prepared. In this case, there is a risk that the pulverizing conditions vary during the pulverizing step.

As previously explained, the toner of the present invention is fixable at a temperature lower than the melting point of the cyclized rubber by dissolving the cyclized rubber in the wax of which melting point is lower than that of the cyclized rubber. Thus, energy saving can be realized.

Even though the obtained toner has a low melting point, the preservation stability of toner is improved because the melting point of the cyclized rubber itself is high.

Further, the change in properties of toner can be minimized because the cyclized rubber for use in the toner is rigid. More specifically, the external additive can be prevented from being pushed into the toner particle, and being stained with a low-molecular-weight resin.

Furthermore, the spent toner phenomenon, toner filming phenomenon, and the like can be effectively inhibited because the cyclized rubber is rigid and has no adhesive properties.

In addition, the obtained toner-image-bearing material does not cause any blocking problem. This is because the employed cyclized rubber has a high melting point and rigidity, and no adhesive properties.

The toner composition of the present invention is appropriately rigid due to the presence of the cyclized rubber, so that the toner particles can be efficiently produced by pulverizing.

Japanese Patent Application No. 2000-132277 filed May 1, 2000 is hereby incorporated by reference.

What is claimed is:

1. A toner for use in electrophotography comprising:

a coloring agent, and a binder which comprises a binder resin comprising a cyclized rubber, said toner being produced by kneading and pulverizing to produce toner particles.

2. The toner as claimed in claim 1, wherein said cyclized rubber is contained in an amount of 10 wt. % or more of the total amount of said binder resin.

3. The toner as claimed in claim 1, wherein said cyclized rubber has a cyclization degree of 40% or more.

4. The toner as claimed in claim 1, wherein said binder further comprises a wax, which dissolves therein said cyclized rubber when heated to the melting point of said wax or above, serving as a solvent for said cyclized rubber.

5. The toner as claimed in claim 4, wherein the composition ratio of said wax to said cyclized rubber (said wax:said cyclized rubber) is (97:3) to (5:95).

6. The toner as claimed in claim 4, wherein the melting point of said wax is lower than the melting point of said cyclized rubber.

7. The toner as claimed in claim 4, wherein said wax has a melt viscosity of 1 to 10,000,000 centipoise at 150° C.

8. The toner as claimed in claim 4, wherein said wax has a penetration of 0 to 20 at 25° C.

9. The toner as claimed in claim 4, wherein said wax comprises at least one wax component selected from the group consisting of paraffin wax, microcrystalline wax, olefin wax, oxidized paraffin wax, oxidized microcrystalline wax, and oxidized olefin wax.

10. The toner as claimed in claim 1, wherein said toner is fixable at or below the melting point of said cyclized rubber.

11. The toner as claimed in claim 4, wherein said toner is fixable at or below the melting point of said cyclized rubber.

12. An electrophotographic image formation method, using a toner comprising:

a coloring agent, and a binder which comprises a binder resin comprising a cyclized rubber, said toner being produced by kneading and pulverizing to produce toner particles.

13. The electrophotographic image formation method as claimed in claim 12, wherein said cyclized rubber is contained in an amount of 10 wt. % or more of the total amount of said binder resin.

14. The electrophotographic image formation method as claimed in claim 12, wherein said cyclized rubber has a cyclization degree of 40% or more.

15. The electrophotographic image formation method as claimed in claim 12, wherein said binder further comprises a wax, which dissolves therein said cyclized rubber when heated to the melting point of said wax or above, serving as a solvent for said cyclized rubber.

16. The electrophotographic image formation method as claimed in claim 15, wherein the composition ratio of said wax to said cyclized rubber (said wax:said cyclized rubber) is (97:3) to (5:95).

17. The electrophotographic image formation method as claimed in claim 15, wherein the melting point of said wax is lower than the melting point of said cyclized rubber.

18. The electrophotographic image formation method as claimed in claim 15, wherein said wax has a melt viscosity of 1 to 10,000,000 centipoise at 150° C.

19. The electrophotographic image formation method as claimed in claim 15, wherein said wax has a penetration of 0 to 20 at 25° C.

20. The electrophotographic image formation method as claimed in claim 15, wherein said wax comprises at least one wax component selected from the group consisting of paraffin wax, microcrystalline wax, olefin wax, oxidized paraffin wax, oxidized microcrystalline wax, and oxidized olefin wax.

21. The electrophotographic image formation method as claimed in claim 12, wherein said toner is fixable at or below the melting point of said cyclized rubber.

22. The electrophotographic image formation method as claimed in claim 15, wherein said toner is fixable at or below the melting point of said cyclized rubber.

* * * * *